US010925328B1

(12) United States Patent
Diskin

(10) Patent No.: US 10,925,328 B1
(45) Date of Patent: Feb. 23, 2021

(54) UPPER TORSO ARTICLE OF CLOTHING

(71) Applicant: PAGE UP GLOBAL INC., Fisher Island, FL (US)

(72) Inventor: Simi K. Diskin, Fisher Island, FL (US)

(73) Assignee: PAGE UP GLOBAL INC., Fisher Island, FL (US)

( * ) Notice: Subject to any disclaimer, the term of this patent is extended or adjusted under 35 U.S.C. 154(b) by 115 days.

(21) Appl. No.: 16/123,313

(22) Filed: Sep. 6, 2018

(51) Int. Cl.
*A41D 27/10* (2006.01)
*A41D 1/04* (2006.01)

(52) U.S. Cl.
CPC ..... *A41D 1/04* (2013.01); *A41D 27/10* (2013.01); *A41D 2200/10* (2013.01)

(58) Field of Classification Search
CPC ..... A41D 1/04; A41D 27/10
USPC ..... 2/16, 59, 50, 69, 44, 46
See application file for complete search history.

(56) References Cited

U.S. PATENT DOCUMENTS 1,833,109 A * 11/1931 Day ..... A41D 3/04 2/87
4,356,570 A * 11/1982 Vernon ..... A41D 13/08 2/126
4,985,934 A * 1/1991 Perry ..... A41D 13/08 2/125
5,327,586 A * 7/1994 Evans ..... A41D 1/14 2/211
8,667,613 B2 * 3/2014 Blakely ..... A41D 13/08 2/16

* cited by examiner

*Primary Examiner* — Gloria M Hale
(74) *Attorney, Agent, or Firm* — Albert Bordas, P.A.

(57) ABSTRACT

An upper torso article of clothing having a skirt with a body, and inner and outer edges. Extending from the inner edge are first and second joining edges that have a common vertex. A belt has first and second belt edges, an exterior face, an interior face, and belt fasteners. A section of the belt is fixed to the first and second joining edges. The skirt is joined to the interior face at the section respectively, whereby the first belt edge is fixed to the first and second joining edges, and the second belt edge is fixed to the skirt. The belt has first and second belt ends. The first belt end extends from the inner edge a first predetermined distance, the second belt end extends from the inner edge a second predetermined distance, and the first and second predetermined distances are not equal.

20 Claims, 4 Drawing Sheets

UPPER TORSO ARTICLE OF CLOTHING

BACKGROUND OF THE INVENTION

1. Field of the Invention

The present invention relates to articles of clothing, and more particularly, to upper torso articles of clothing.

2. Description of the Related Art

The textile industry is the second most polluting industry on the planet. Each year at a global level, grow cotton for virgin threads uses approximately 40 trillion gallons of water and 12,800,000,000 ounces of pesticides. As an example, making and processing fabrics for a conventional T-shirt requires approximately 700 gallons of water and 2.5 ounces of pesticides. The effect of pesticides is devastating to our earth, wildlife, and farmers alike whereby approximately 12.8 billion pounds of pesticides are used yearly in the United States alone that contaminate grounds, water, rivers, and oceans. Of all the crops in the world, cotton is sprayed with the most chemicals. 60% of the world's cotton is used for clothing and another 35% for home furnishings.

In addition, approximately 11 million tons of clothing is discarded in the United States alone every year. This amount equates to approximately 70 pounds per person in the United States. Not only does this seriously contribute to a growing waste crisis, but it also is a true waste considering that nearly 99% of textiles are recyclable. The United States generates a staggering 25 billion pounds of post consumer textile waste per year and that figure is projected to increase yearly by 2%. That being said, only about 15% of clothing is donated or recycled.

Applicant is not aware of any upper torso articles of clothing having the novel features of the present invention.

SUMMARY OF THE INVENTION

The present invention is an upper torso article of clothing, comprising a sleeve, having an inner edge and an outer edge. Extending from the inner edge towards, but without reaching the outer edge, are first and second joining edges. The sleeve, further comprises a sleeve body. The first and second joining edges comprise a common vertex.

The present invention further comprises a belt having a predetermined length. The belt comprises first and second belt edges, an exterior face, an interior face, and belt fasteners. A section of the belt is fixed to the first and second joining edges.

The present invention, and specifically the sleeve and belt, are from any articles of clothing, whether new, discarded, refurbished, recycled, and/or resold.

More specifically, the sleeve is joined to the interior face at the section respectively, whereby the first belt edge is fixed to the first and second joining edges, and the second belt edge is fixed to the sleeve. In a preferred embodiment, the belt is fixed to the first and second joining edges, and the sleeve, with stitching.

The belt comprises first and second belt ends. The first belt end extends from the inner edge a first predetermined distance, the second belt end extends from the inner edge a second predetermined distance, and the first and second predetermined distances are not equal.

It is therefore one of the main objects of the present invention to provide upper torso articles of clothing.

It is another object of this invention to provide an upper torso article of clothing comprising a sleeve and a belt.

It is another object of this invention to provide an upper torso article of clothing comprising a sleeve and a belt, whereby the sleeve is worn over a shoulder and extends around a corresponding arm of a user.

It is yet another object of this invention to provide upper torso articles of clothing that is inexpensive to manufacture.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
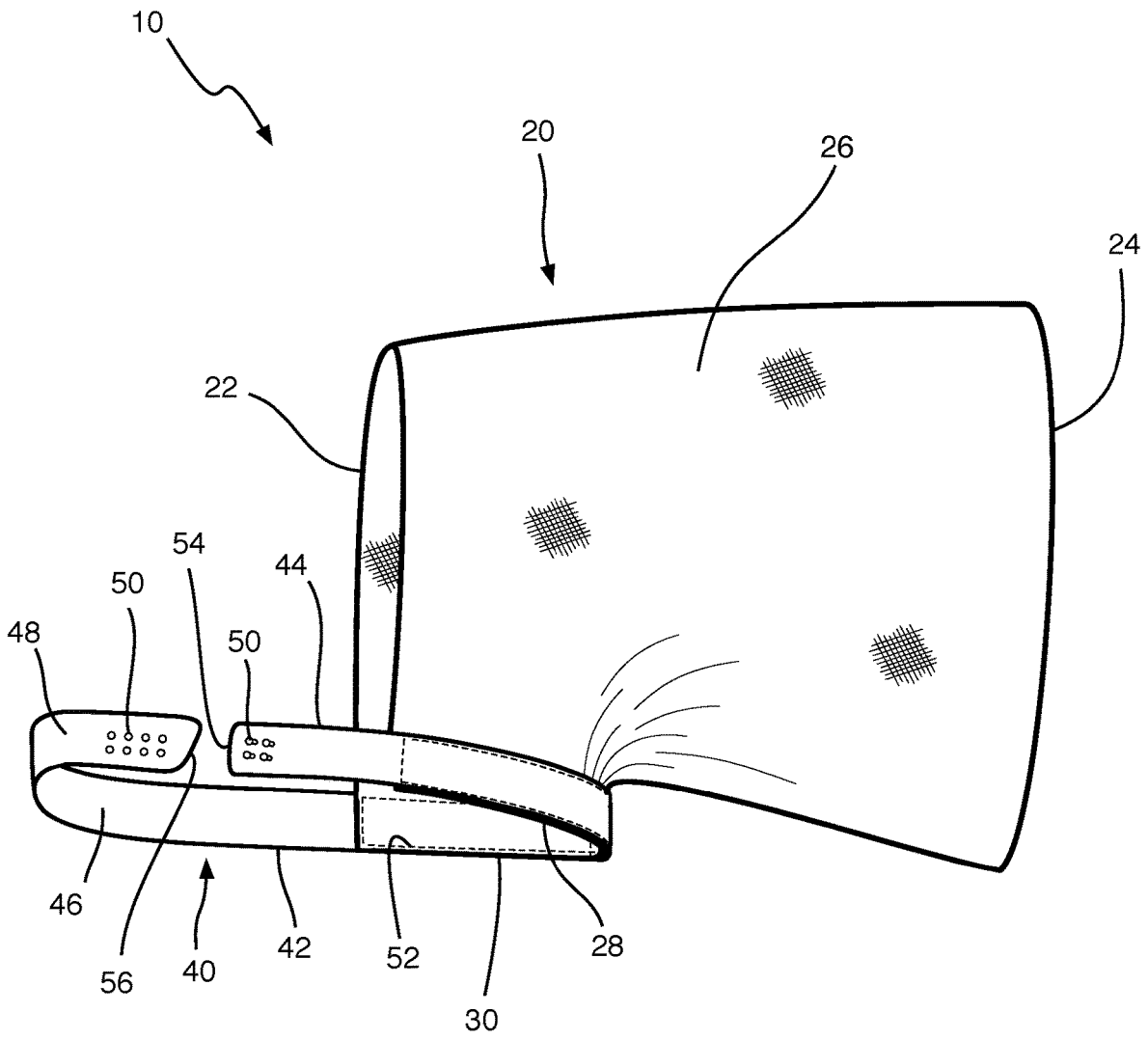
FIG. 1 is a front isometric view of the present invention.

Referring now to the drawings, the present invention is an upper torso article of clothing, and is generally referred to with numeral 10. It can be observed that it basically includes sleeve 20 and belt 40.

As seen in FIG. 1, upper torso article of clothing 10 comprises sleeve 20 having inner edge 22 and outer edge 24. Extending from inner edge 22, towards but without reaching outer edge 24, are joining edges 28 and 30. Joining edges 28 and 30 comprise a common vertex. In one embodiment, joining edges 28 and 30 are approximately perpendicular to inner edge 22. Sleeve 20 further comprises sleeve body 26. Sleeve 20 may be made of any material(s), including but not limited to, cotton, flax, wool, ramie, silk, leather, polyester, and/or combinations thereof. Sleeve 20 may include, but is not limited to designs, studs, buttons, holes, jewelry, prints, patterns, and/or combinations thereof.

Belt 40 has a predetermined length and may be made of any material(s), including but not limited to, cotton, flax, wool, ramie, silk, leather, polyester, and/or combinations thereof. Belt 40 may include, but is not limited to designs, studs, buttons, holes, jewelry, prints, patterns, and/or combinations thereof. A section of belt 40 is fixed to joining edges 28 and 30. In a preferred embodiment, the section of belt 40 is approximately parallel to joining edges 28 and 30. The section of belt 40 is also approximately on a same axis as joining edges 28 and 30.

Belt 40 comprises belt edges 42 and 44. Belt 40 further comprises interior face 46, exterior face 48, and belt fasteners 50. Belt fasteners 50 include, but are not limited to snaps, studs, hook and loop fasteners, magnets, buttons, zippers, holes, and/or buckles including, but not limited to screw closure buckles, clamp closure buckles, stitch closure buckles, tongue buckles, double side buckles, reversible buckles, double ring buckles, autogrip buckles, clip buckles, wrestling buckles, auto lock buckles, pin buckles, flip closure buckles, self defense buckles, automatic locking splice buckles, utility buckles, automatic latch buckles, webbing buckles, clip on buckles, clip latch buckles, and rigger's belt buckles.

Sleeve 20 is joined to a portion of interior face 46. Belt edge 42 is fixed to joining edges 28 and 30, and belt edge 44 is fixed sleeve 20. In a preferred embodiment, belt 40 is fixed to joining edges 28 and 30 and sleeve 20 with stitching 52. In other embodiments, belt 40 is fixed to joining edges 28 and 30 and sleeve 20 with snaps, buttons, zippers, and/or any fastening devices or fastening means. Belt 40 comprises belt ends 54 and 56. In the illustrated embodiment, belt end 54 extends from inner edge 22 a first predetermined distance, belt end 56 extends from inner edge 22 a second predetermined distance, and the first and second predetermined distances are not equal.

Figure 2:
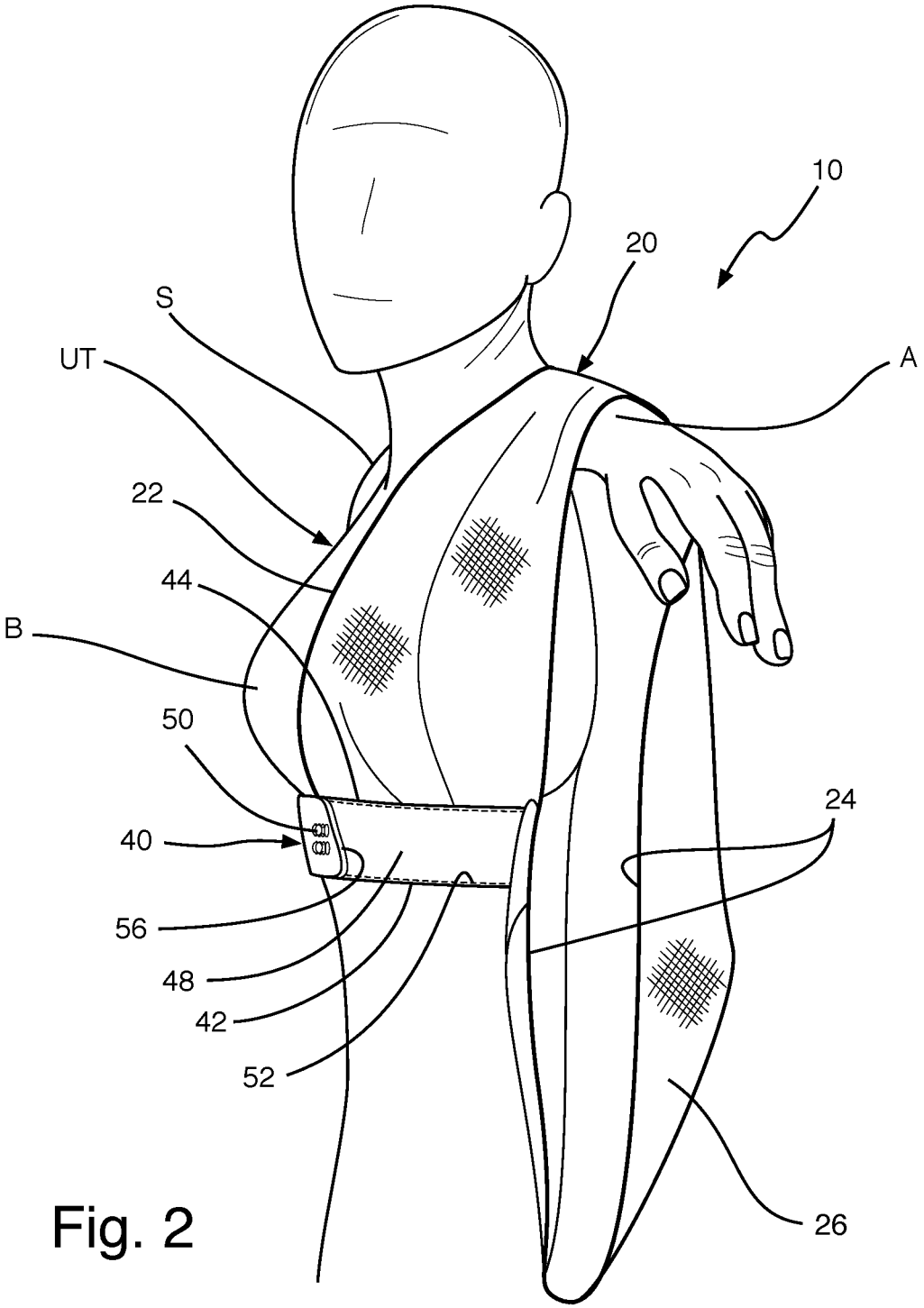
FIG. 2 is a lateral isometric view of the present invention as worn by a user.
Figure 3:
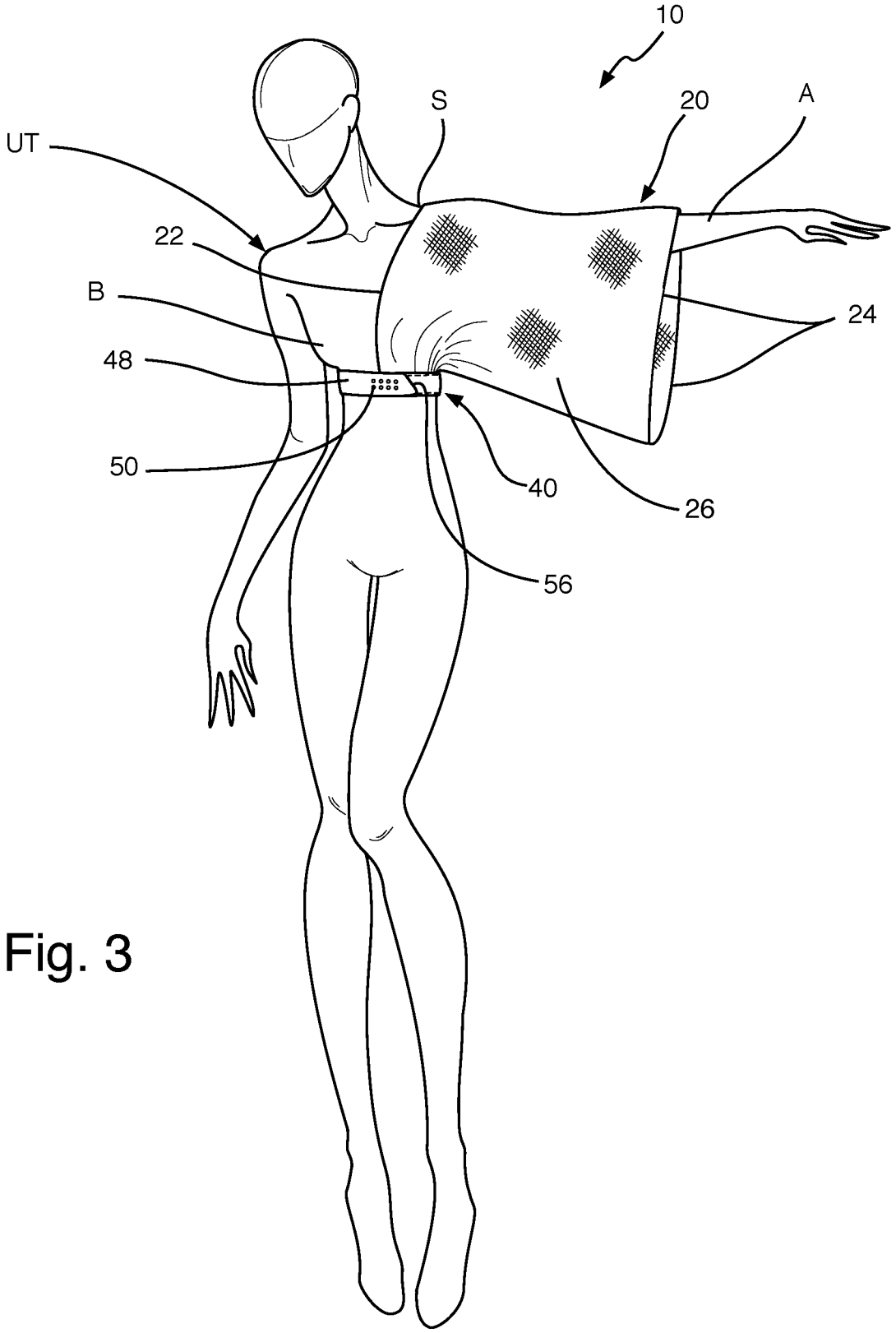
FIG. 3 is a front isometric view of the present invention as worn by a user.
Figure 4:
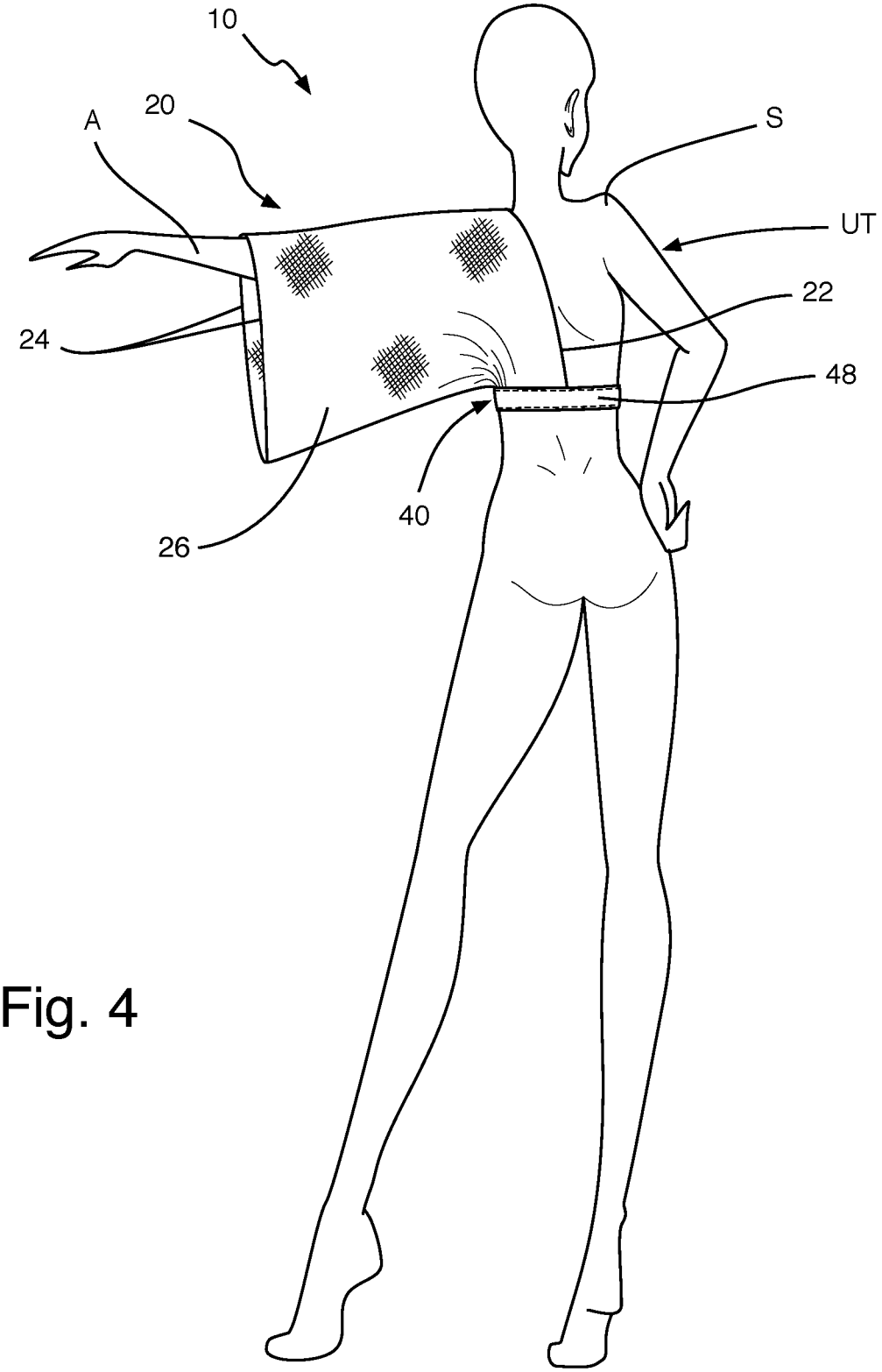
FIG. 4 is a rear isometric view of the present invention as worn by a user.

As seen in FIGS. 2, 3, and 4 present invention 10 is designed as a clothing article for upper torso UT, and more specifically as a clothing article to cover one shoulder S and one arm A of a user's upper torso UT.

In a preferred usage, belt 40 is secured at upper torso UT above the waist of a user. Inner edge 22, and an adjacent section of sleeve 20, rests on one shoulder S, and sleeve body 26 extends around arm A as a sleeve.

As seen in FIG. 3, at the front side of the user, inner edge 22 extends from shoulder S, partially diagonally between breasts B, to keep inner edge 22 secured at shoulder S.

As seen in FIG. 4, at the back side of the user, inner edge 22 extends from shoulder S, partially diagonally across the user's back, to keep inner edge 22 secured at shoulder S.

The illustrations show present invention 10 configured to cover the left arm A of the user. It is understood however, that present invention 10 may be manufactured/assembled to cover the user's right arm as well. In addition, present invention 10 may be of any size to fit any user, whereby sleeve 20 and belt 40 may be of any size.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An upper torso article of clothing, comprising:

A) a sleeve having an inner edge and an outer edge, extending from said inner edge towards but without reaching said outer edge are first and second edges; and B) a belt having a predetermined length, a section of said belt is fixed to said first and second edges.

2. The upper torso article of clothing set forth in claim 1, further characterized in that said sleeve further comprises a sleeve body.

3. The upper torso article of clothing set forth in claim 1, further characterized in that said first and second edges comprise a common vertex.

4. The upper torso article of clothing set forth in claim 1, further characterized in that said belt comprises first and second belt edges.

5. The upper torso article of clothing set forth in claim 1, further characterized in that said belt further comprises an exterior face.

6. The upper torso article of clothing set forth in claim 1, further characterized in that said belt further comprises an interior face.

7. The upper torso article of clothing set forth in claim 1, further characterized in that said belt further comprises belt fasteners.

8. The upper torso article of clothing set forth in claim 6, further characterized in that said sleeve is joined to said interior face at said section respectively.

9. The upper torso article of clothing set forth in claim 4, further characterized in that said first belt edge is fixed to said first and second edges.

10. The upper torso article of clothing set forth in claim 4, further characterized in that said second belt edge is fixed to said sleeve.

11. The upper torso article of clothing set forth in claim 1, further characterized in that said belt is fixed to said first and second edges and said sleeve with stitching.

12. The upper torso article of clothing set forth in claim 1, further characterized in said belt comprises first and second belt ends.

13. The upper torso article of clothing set forth in claim 12, further characterized in that said first belt end extends from said inner edge a first predetermined distance.

14. The upper torso article of clothing set forth in claim 13, further characterized in that said second belt end extends from said inner edge a second predetermined distance.

15. The upper torso article of clothing set forth in claim 14, further characterized in that said first and second predetermined distances are not equal.

16. An upper torso article of clothing, comprising:

A) a sleeve having a sleeve body, an inner edge and an outer edge, extending from said inner edge towards but without reaching said outer edge are first and second edges, said first and second edges comprise a common vertex; and B) a belt having a predetermined length, a section of said belt is fixed to said first and second edges.

17. The upper torso article of clothing set forth in claim 16, further characterized in that said belt comprises first and second belt edges, an exterior face, an interior face, and belt fasteners.

18. The upper torso article of clothing set forth in claim 17, further characterized in that said sleeve is joined to said interior face at said section respectively, whereby said first belt edge is fixed to said first and second edges, and said second belt edge is fixed to said sleeve.

19. The upper torso article of clothing set forth in claim 18, further characterized in that said belt is fixed to said first and second edges and said sleeve with stitching.

20. The upper torso article of clothing set forth in claim 16, further characterized in said belt comprises first and second belt ends, whereby said first belt end extends from said inner edge a first predetermined distance, said second belt end extends from said inner edge a second predetermined distance, and said first and second predetermined distances are not equal.

* * * * *